US009534445B2

(12) United States Patent
Korchounov

(10) Patent No.: US 9,534,445 B2
(45) Date of Patent: Jan. 3, 2017

(54) ROTARY STEERABLE TOOL

(76) Inventor: Alexandre Korchounov, Calgary (CA)

( * ) Notice: Subject to any disclaimer, the term of this patent is extended or adjusted under 35 U.S.C. 154(b) by 280 days.

(21) Appl. No.: 14/116,377

(22) PCT Filed: May 30, 2012

(86) PCT No.: PCT/CA2012/050358
§ 371 (c)(1),
(2), (4) Date: Nov. 8, 2013

(87) PCT Pub. No.: WO2012/162833
PCT Pub. Date: Dec. 6, 2012

(65) Prior Publication Data

US 2014/0083777 A1 Mar. 27, 2014

Related U.S. Application Data

(60) Provisional application No. 61/491,298, filed on May 30, 2011.

(51) Int. Cl.
*E21B 7/06* (2006.01)
*E21B 7/04* (2006.01)

(52) U.S. Cl.
CPC *E21B 7/04* (2013.01); *E21B 7/062* (2013.01)

(58) Field of Classification Search
CPC ..... E21B 7/04; E21B 7/06; E21B 7/062
USPC ..... 175/61, 62
See application file for complete search history.

(56) References Cited

U.S. PATENT DOCUMENTS 2,179,567 A * 11/1939 Strength ..... E21B 7/062 175/73
2,819,039 A * 1/1958 Lindsay ..... E21B 7/062 175/73
3,370,657 A * 2/1968 Antle ..... E21B 7/062 175/230
4,394,881 A * 7/1983 Shirley ..... E21B 7/062 166/319

(Continued)

OTHER PUBLICATIONS

Jonny Haugen and Baker Hughes, "Rotary Steerable System Replaces Slide Mode for Directional Drilling Applications", Oil and Gas Journal, Mar. 2, 1998. URL: http://www.ogj.com/articles/print/volume-96/issue-9/in-this-issue/general-interest/rotary-steerablesystem-replaces-slide-mode-for-directional-drilling-applications.html.

(Continued)

*Primary Examiner* — Kenneth L Thompson
(74) *Attorney, Agent, or Firm* — Davis & Bujold PLLC; Michael J. Bujold

(57) ABSTRACT

A rotary steerable tool has an inner mandrel having a longitudinal axis and an outer housing positioned along the inner mandrel. The outer housing rotates independently of the inner mandrel. The outer housing has an engagement member that moves axially relative to the outer housing and the inner mandrel between an extended position and a retracted position, and a transition surface having a slope relative to an outer surface of the outer housing. The engagement member moves along the transition surface between the extended position and the retracted position. In the engaged position, the engagement member extends outward from the outer housing to engage an inner surface of a well being drilled. An actuator selectively moves the engagement member along the transition surface from the retracted position to the extended position.

19 Claims, 8 Drawing Sheets

(56) References Cited

U.S. PATENT DOCUMENTS

| | | | | |
|---|---|---|---|---|
| 4,947,944 | A * | 8/1990 | Coltman | E21B 17/1014 175/325.3 |
| 5,201,375 | A | 4/1993 | Base et al. | |
| 5,310,012 | A * | 5/1994 | Cendre | E21B 23/04 175/269 |
| 5,311,953 | A * | 5/1994 | Walker | E21B 17/1014 175/107 |
| 5,318,137 | A | 6/1994 | Johnson et al. | |
| 5,603,386 | A | 2/1997 | Webster | |
| 5,836,406 | A | 11/1998 | Schuh | |
| 6,213,226 | B1 | 4/2001 | Eppink et al. | |
| 6,427,783 | B2 * | 8/2002 | Krueger | E21B 7/06 175/325.3 |
| 6,761,232 | B2 | 7/2004 | Moody et al. | |
| 6,840,336 | B2 | 1/2005 | Schaaf et al. | |
| 6,892,830 | B2 * | 5/2005 | Noe | E21B 7/062 175/61 |
| 7,306,056 | B2 | 12/2007 | Ballantyne et al. | |
| 7,306,058 | B2 | 12/2007 | Cargill et al. | |
| 7,373,995 | B2 | 5/2008 | Hughes et al. | |
| 7,971,662 | B2 | 7/2011 | Beuershausen | |
| 8,011,452 | B2 | 9/2011 | Downton | |
| 8,087,479 | B2 | 1/2012 | Kulkarni et al. | |
| 8,104,548 | B2 | 1/2012 | Ma et al. | |
| 2010/0089583 | A1 | 4/2010 | Xu et al. | |
| 2011/0031023 | A1 | 2/2011 | Menezes et al. | |
| 2012/0018219 | A1 | 1/2012 | Runia | |

OTHER PUBLICATIONS

Sandro Poli and Franco Donati of Agip S.p. A. and Joachim Oppelt, Detlef Ragnitz and Baker Hughes of INTEQ GmbH, "Advanced Tools for Advanced Wells: Rotary Closed Loop Drilling System—Results of Prototype Field Testing", One Petro, Society of Petroleum Engineers, vol. 13, No. 2, Jun. 1998 URL: http://www.onepetro.org/mslib/app/Preview.do?paperNumber=00036884&societyCode=SPE.

International Search Report Corresponding to PCT/CA2012/050358 mailed Jul. 17, 2012.

International Preliminary Report on Patentability Corresponding to PCT/CA2012/050358 mailed Dec. 2, 2013.

* cited by examiner

ROTARY STEERABLE TOOL

FIELD

This relates to a rotary steerable tool that is designed for use in drilling applications to help steer the drilling string.

BACKGROUND

In directional drilling, it is necessary to steer the drill bit in order to obtain the horizontal portion of the well, or to correct the drilling angle. When the drill bit is driven by a rotating body, this involves steering the tool in a constant direction despite the rotating tool.

SUMMARY

According to an aspect, there is provided a rotary steerable tool, comprising an inner mandrel having a longitudinal axis and an outer housing positioned along the inner mandrel. The outer housing comprises an engagement member that moves axially relative to the outer housing between an extended position and a retracted position and a transition surface having a slope relative to an outer surface of the outer housing. The engagement member moves along the transition surface between the extended position and the retracted position. In the engaged position, the engagement member extends outward from the outer housing to engage an inner surface of a wellbore. The outer housing rotates independently of the inner mandrel when the engagement member is in the engaged position. There is an actuator that selectively moves the engagement member along the transition surface from the retracted position to the extended position.

According to another aspect, the engagement member may comprise a friction surface that engages the inner surface of the well being drilled in the extended position. The friction surface may be connected to an internal portion by a pivoting connection. The friction surface may comprise a plurality of sharp points.

According to another aspect, the actuator may comprise an electric or mechanical motor and a threaded rod, a hydraulic power source and a piston, or a hydraulically actuated ring.

According to another aspect, the outer housing may be a split case.

According to another aspect, the inner mandrel may be connected to a drill string.

According to another aspect, the drill string may comprise stabilizer members mounted at least one of above and below the outer housing.

According to another aspect, the outer housing may comprise a plurality of engagement members having a different height.

According to another aspect, the outer housing may comprise a pressure equalization valve.

According to another aspect, there is provided a drill string for directional drilling, comprising a rotary drill string body carrying a drill bit at a lower end of the rotary drill string body, and a rotary steerable tool spaced from the drill bit as described above.

According to another aspect, there is provided a method of directional drilling, comprising the steps of securing an outer housing on a drill string, the outer housing comprising an engagement member that moves axially relative to the outer housing between an extended position and a retracted position and a transition surface having a slope relative to an outer surface of the outer housing; actuating the engagement member to move along the transition surface from the retracted position to the extended position such that the engagement member extends outward from the outer housing and engages an inner surface of a wellbore, the engagement member inducing a bend in the drill string; and rotating the drill string independently of the outer housing when the engagement member is in the engaged position against the inner surface of the wellbore.

According to another aspect, the method may further comprise the step of applying downward pressure to the drill string, the downward pressure further inducing a bending force on the drill string.

According to another aspect, the engagement member may comprises a friction surface, the friction surface engaging the inner surface of the wellbore to prevent rotation of the outer housing as the drill string rotates. The friction surface may comprise a plurality of sharp points.

Other aspects will be apparent from the specification and drawings.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

A rotary steerable tool will now be described with reference to FIG. 1 through 10.

Figure 1:
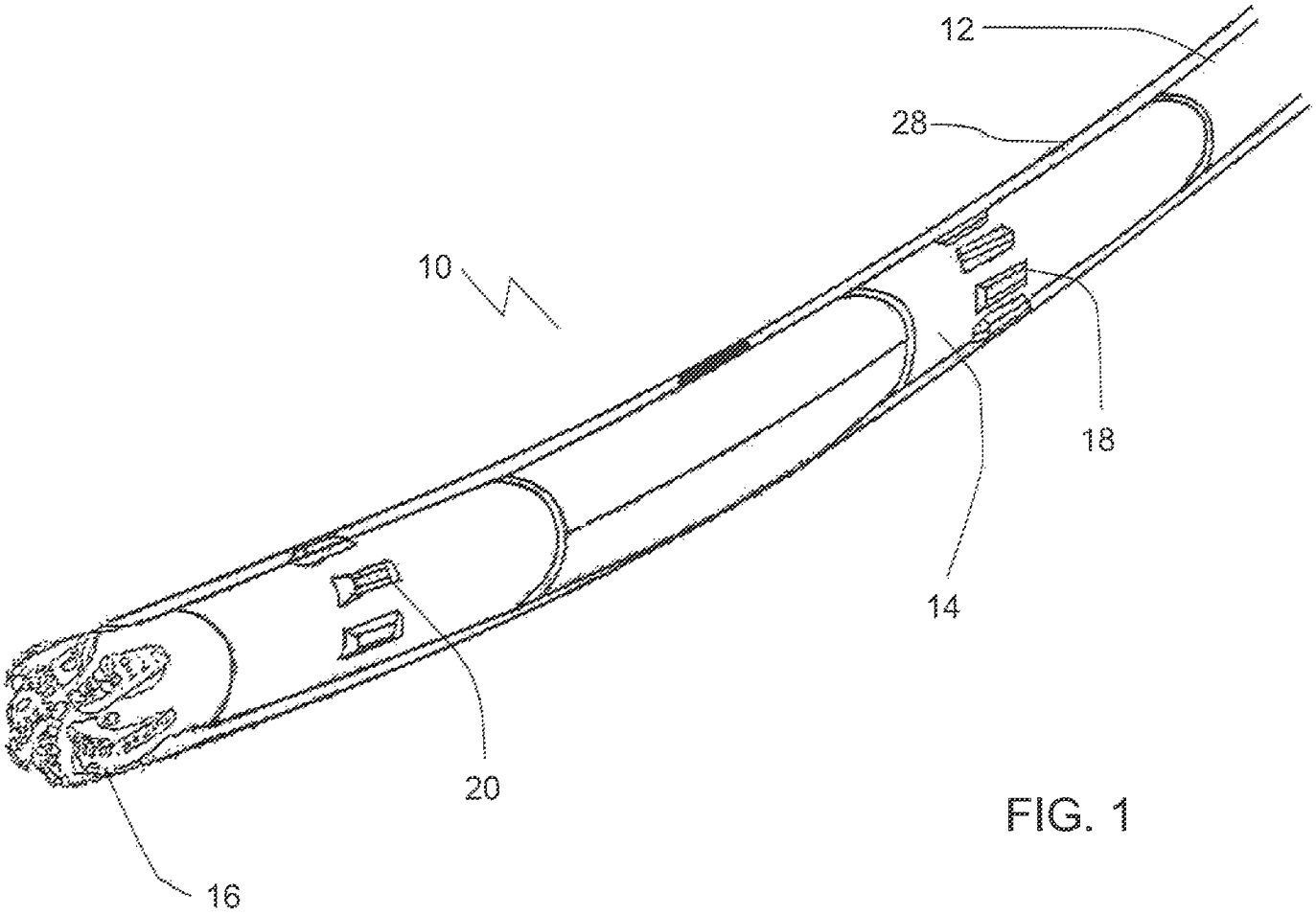
FIG. 1 is a perspective view of the tool installed in a drill string.

Referring to FIG. 1, the tool, generally indicated by reference numeral 10, is designed to be installed in a rotary drill string 12, and is primarily designed for use in directional drilling. The tool may be used in other situations where a rotary steerable tool may be required. Rotary drill string 12 includes a rotating mandrel 14, a drill bit 16, upper stabilizers 18 and lower stabilizers 20. While upper and lower stabilizers 18 and 20 are indicated, it will be understood that a bend may also be achieved with only one set of stabilizers 18 or 20. The degree and direction of the bend may be controlled by the position and distance of stabilizers 18 or 20 from tool 10. Preferably, rotary drill string 12 is non-magnetic or otherwise designed for use with measurement-while drilling (MWD) equipment.

Figure 2:
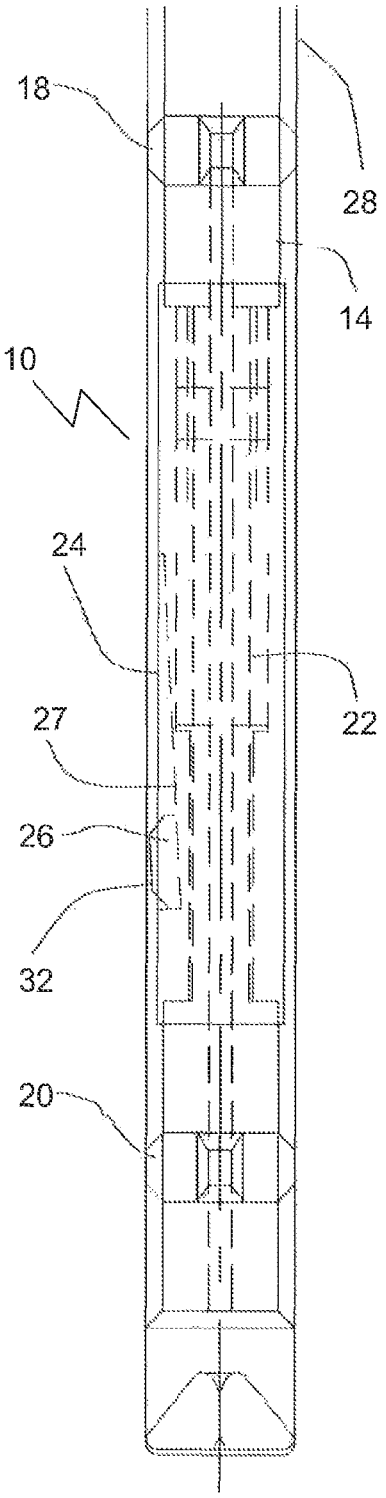
FIG. 2 is a side elevation view in section of the tool installed in a drill string in a disengaged position.
Figure 3:
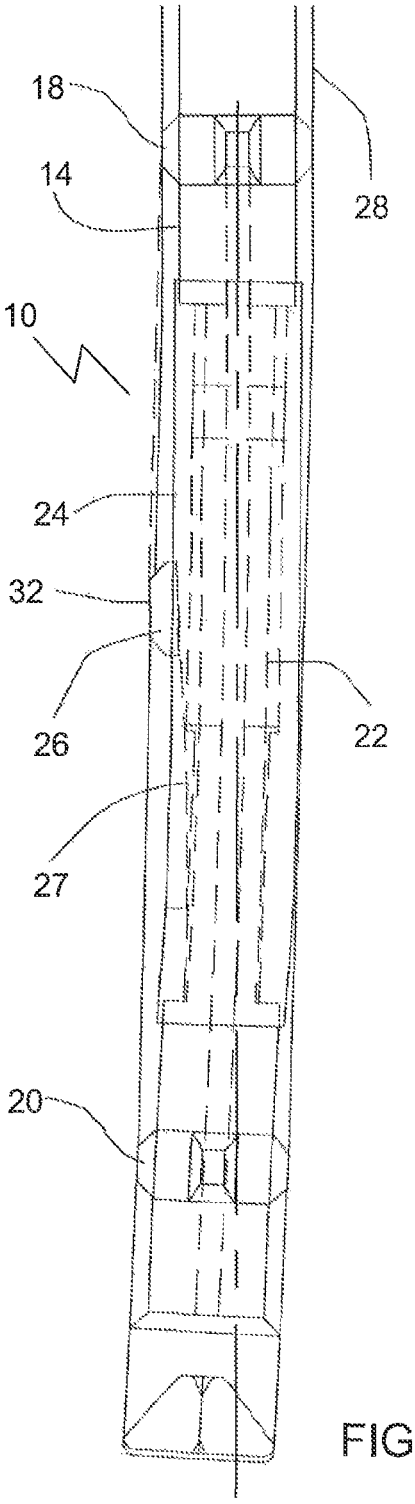
FIG. 3 is a side elevation view in section of tool installed in a drill string in an engaged position.

Referring to FIGS. 2 and 3, tool 10 is located on a smaller diameter section 22 of mandrel 14 and includes an outer housing 24. As depicted, outer housing 24 is split along its axis into two sections to allow it to be installed over section 22 of mandrel 14. Outer housing 24 may be divided into more than two sections, however this may affect the strength of outer housing 24. The sections may be divided unequally to make one section larger than the other, for example, 5/9 and 4/9. This provides more room or strength for components installed in that section. The two sections are preferably connected by pins, but may also be attached in other ways known to those in the art. For example, all or a portion of the outer surface of outer housing 24 may be threaded, such that one or more threaded collars may be installed over outer housing 24 to keep the sections together. This may be done in addition to, or in place of, the pin or other type of connection. Alternatively, rather than splitting housing 24, mandrel 14 may be split in two parts along its length, such that the two parts may be attached together, such as by being threaded together, once outer housing 24 is placed over inner mandrel 22. Outer housing 24 rotates independently of mandrel 14. This is necessary when engaged, although it may be optionally locked to mandrel 14 when not engaged to create a bend. Outer housing 24 is preferably the same diameter as drill string 12, but may also be slightly larger or smaller.

Figure 4:
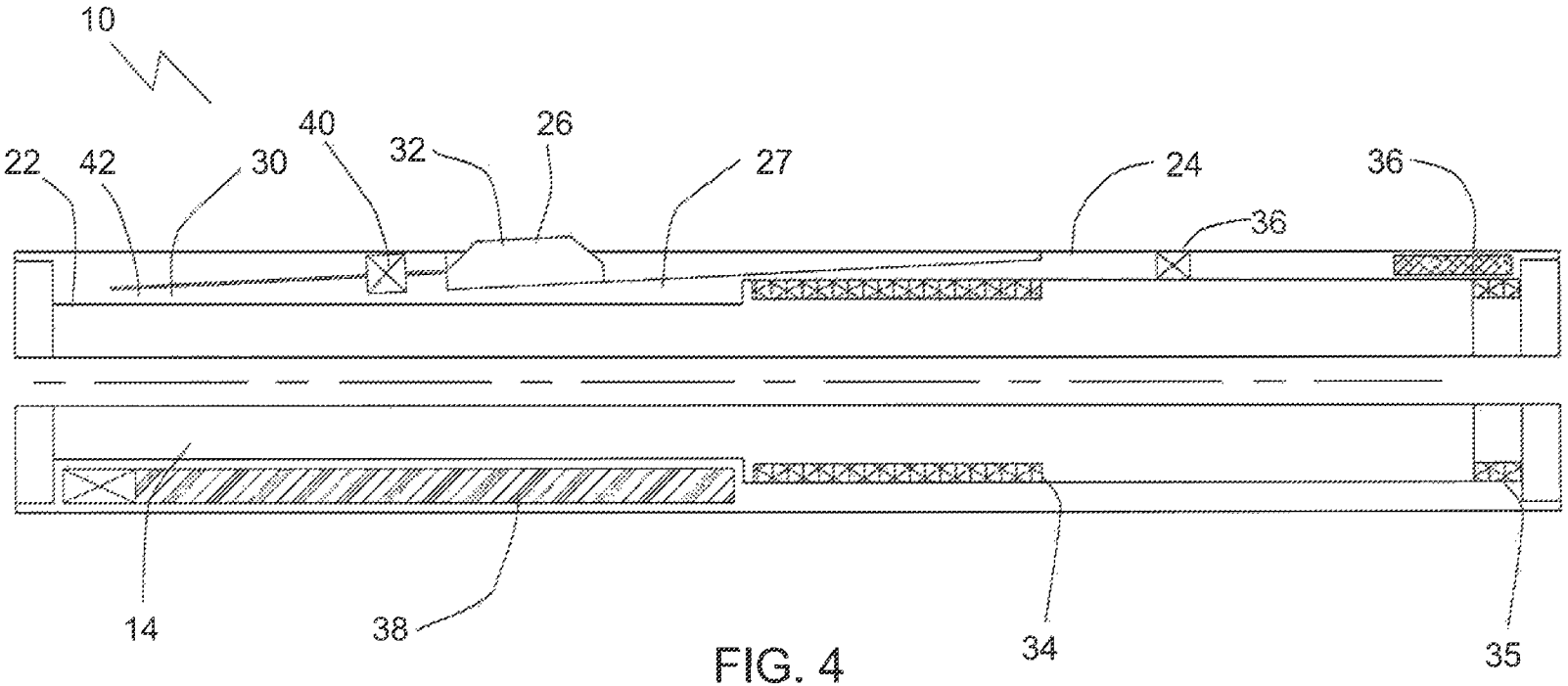
FIG. 4 is a detailed side elevation view in section of the tool in a disengaged position.
Figure 10:
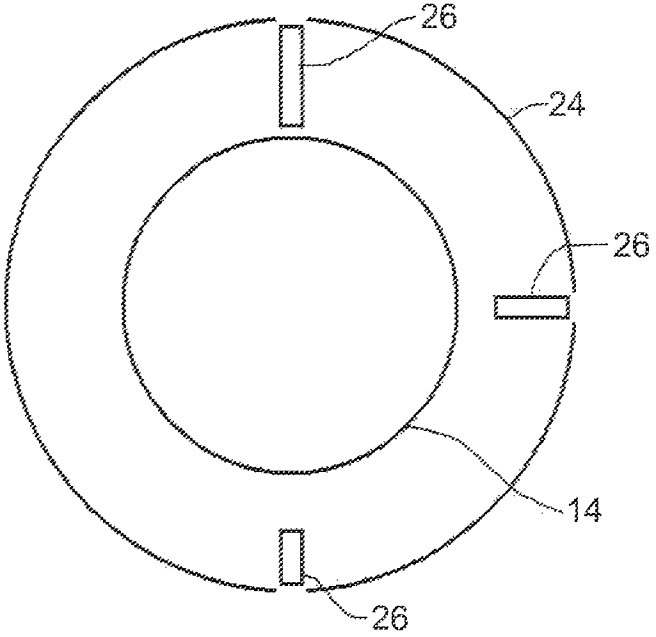
FIG. 10 is a simplified end elevation view in section of the tool with multiple engagement members.

Outer housing 24 houses an engagement member 26 that moves axially relative to outer housing 24 and inner mandrel 14 between a retracted position as shown in FIG. 2 and an extended position shown in FIG. 3. Housing 24 also has a transition surface 27 with a slope, such that engagement member 26 moves along transition surface 27 between the retracted and extended positions. Referring to FIG. 4, engagement member 26 is controlled by an actuator 30 that selectively moves engagement member 26 along transition surface 27 from the retracted position to the extended position. Referring to FIG. 3, in the engaged position, engagement member 26 extends outward from outer housing 24 to engage an inner surface of a wellbore 28 that is being drilled. Preferably, engagement member 26 has a friction surface 32 in order to grip wellbore 28 in the extended position. In a preferred embodiment, the friction surface is made up of several sharp triangular edged points that, when engaged, will carve grooves into the side of the wellbore 28. While engagement member 26 is engaged the pressure on the wellbore 28 will not be strong enough to prevent the movement of tool 10 along wellbore 28. Referring to FIG. 10, it will be understood that there may be more than one engagement member 26. For example, there may be different sizes of engagement member 26, which would allow different angles to be applied while directional drilling without pulling out the drilling string. Engagement members 26 may be spaced in different ways about outer housing 24. In this embodiment, outer housing 24 would be positioned such that the preferred engagement member 26 is properly oriented, and that member would be actuated, while the others remain retracted.

Referring to FIG. 4, there may be other components within housing 24 that may be useful in the operation of tool 10. For example, housing 24 may include bearings 34 and 35 between housing 24 and inner mandrel 22. As an increased load is applied to housing 24 and mandrel 22 when engagement member 26 is extended, one set of bearings 34 is preferably set below the extended position of engagement member 26 to support this load. There is also preferably a MWD sensor 36 that moves with housing 24. This allows the operator at surface to know the orientation of housing 24, such that the bend can be applied in the proper direction to drill string 12. There may also be components of actuator 30, such as a power supply, or battery 38. Outer housing 24 also preferably has a pressure balancing valve 39 to balance and control the hydrostatic pressure. Pressure balancing valve 39 may take various forms as will be recognized by those skilled in the art.

There will now be described the various ways in which tool 10 may be actuated. Referring to FIG. 2 through 4, a first embodiment is shown. In this embodiment, an electric motor 40 is used to drive a threaded rod 42. Motor 40 could also be mechanical. Threaded rod 42 is placed against engagement member 26. As electric motor 40 is actuated, threaded rod 42 causes engagement member 26 to move up transition surface 27. As engagement member 26 moves outward, friction surface 32 engages wellbore 28. Drill string 12 is moved downward during this process such that, as friction surface 32 engages wellbore 28, the friction created helps continue the upward movement of engagement member 26 and induce a bend in drill string 12. In other words, the downward movement and weight of drill string 12 helps create the necessary bend when a friction surface 32 is used. In addition, the slope of transition surface 27 provides a mechanical advantage to push actuator 14 outward and induce a bend in drill string 12. By properly designing the angle of transition surface 27, actuator 14 does not need to be strong enough to bend drill string 12 as it moves along transition surface 27, which reduces the power requirements in tool 10.

In the process of regular rotary drilling, tool 10 does not need to be engaged and can be permitted to spins together with drill string 12. When the need to correct the drilling angle arises, tool 10 is engaged to the position shown in FIG. 3 by the operator at surface. For this to occur, the rotary drilling process is stopped and all of the tools are picked up a certain distance, preferably several meters, from the last location. Tool 10 is then properly oriented, such as by using a signal from MWD sensor 36 that is sent to the surface, where a decision is made by the directional driller to rotate tool 10 to face to the desired direction. Once properly oriented, the signal is then sent to engage tool 10 by causing actuator 14 to move engagement member 26 as described herein.

Due to the fact that the MWD tools are located much closer to the drilling bit, all the measurements and locations received at the rig floor are much more accurate and current. Engagement member 26 preferably has several sharp triangular edged points acting as a friction surface 32. When engaged, it presses against the side of wellbore 28, causing a slight deviation from the longitudinal axis of the drill string 12. When the weight on drill string 12 is applied, it causes friction surface 32 to dig into the side of wellbore 28 even more. As drill string 12 starts to rotate and drill, even more pressure is applied, causing friction surface 32 to scrape or create grooves in the side of wellbore 28, preventing outer housing 24 from rotating around inner mandrel 14, hence creating a greater deviation from the longitudinal axis and thereby accomplishing directional drilling.

Figure 5:
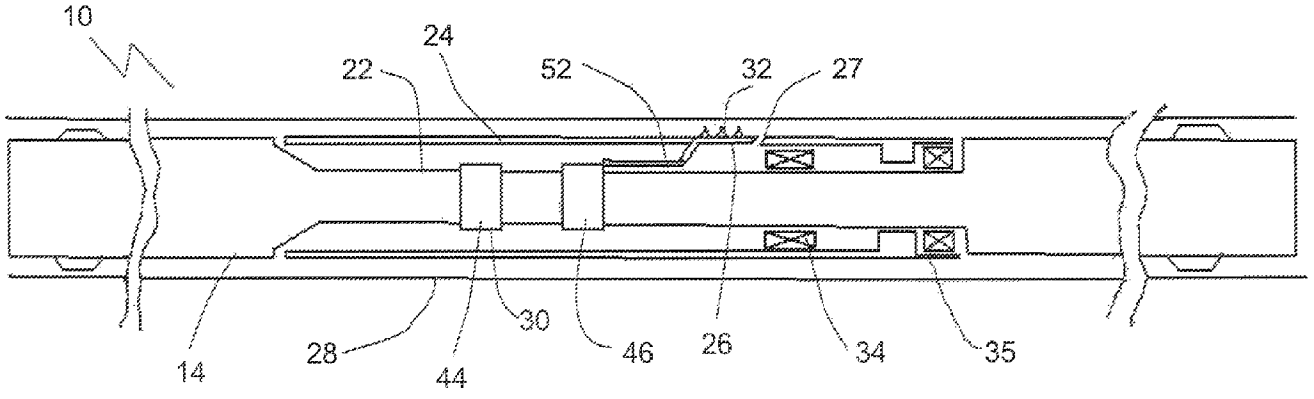
FIG. 5 is a side elevation view in section of an alternative tool in a disengaged position.
Figure 6:
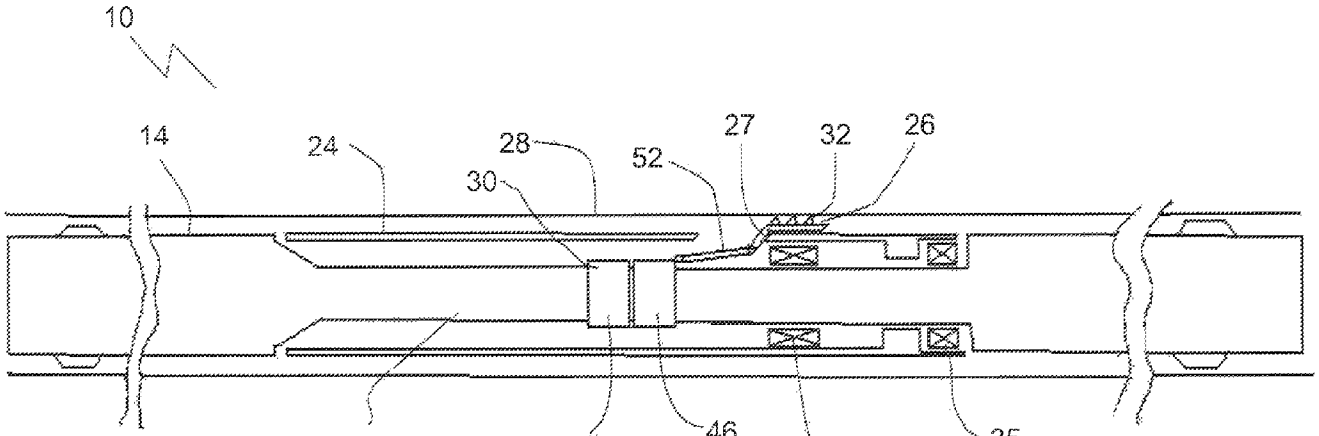
FIG. 6 is a side elevation view in section of an alternative tool in an engaged position.
Figure 7:
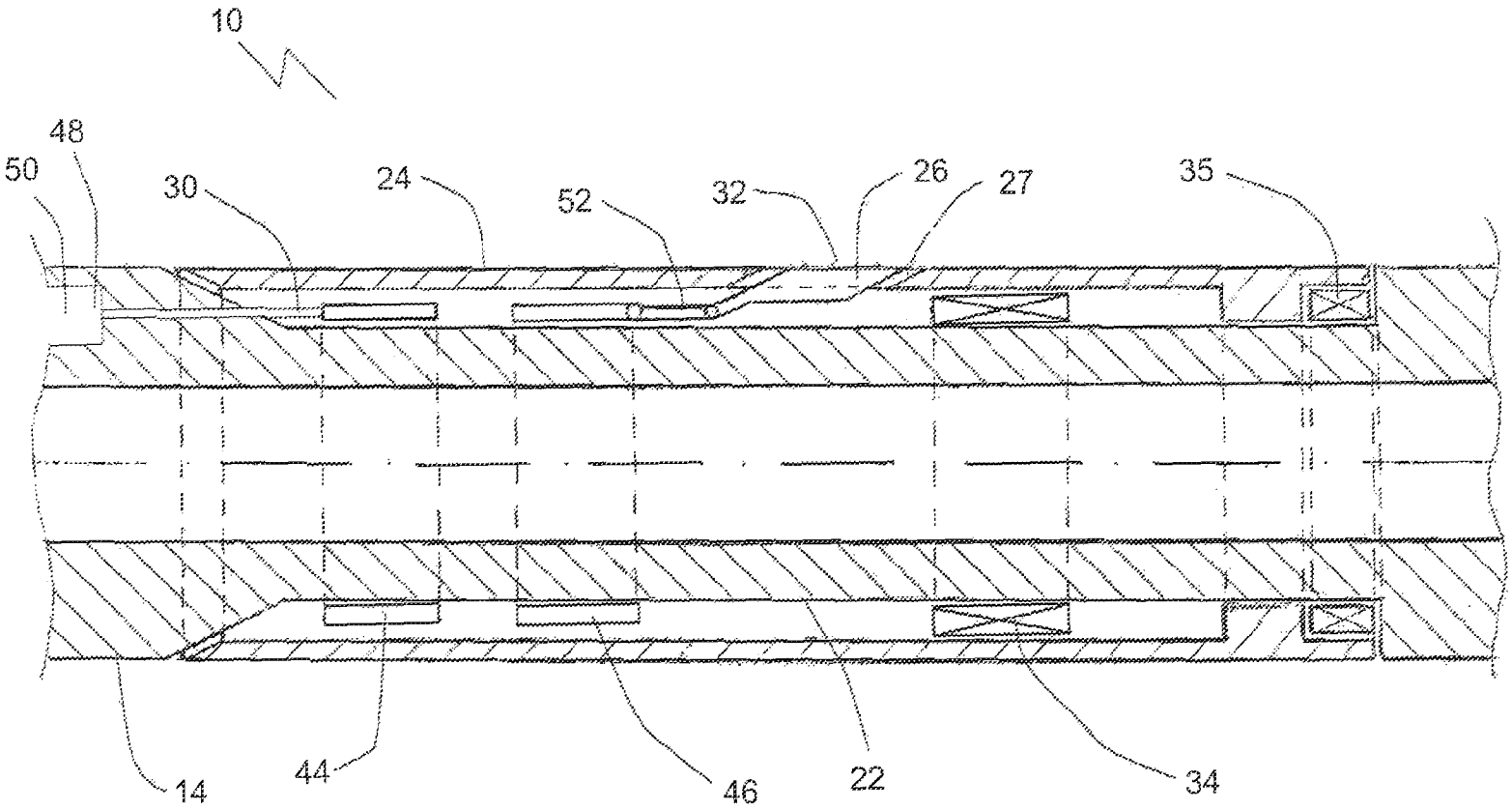
FIG. 7 is a side elevation view in section of a mechanically actuated tool in a disengaged position.
Figure 8:
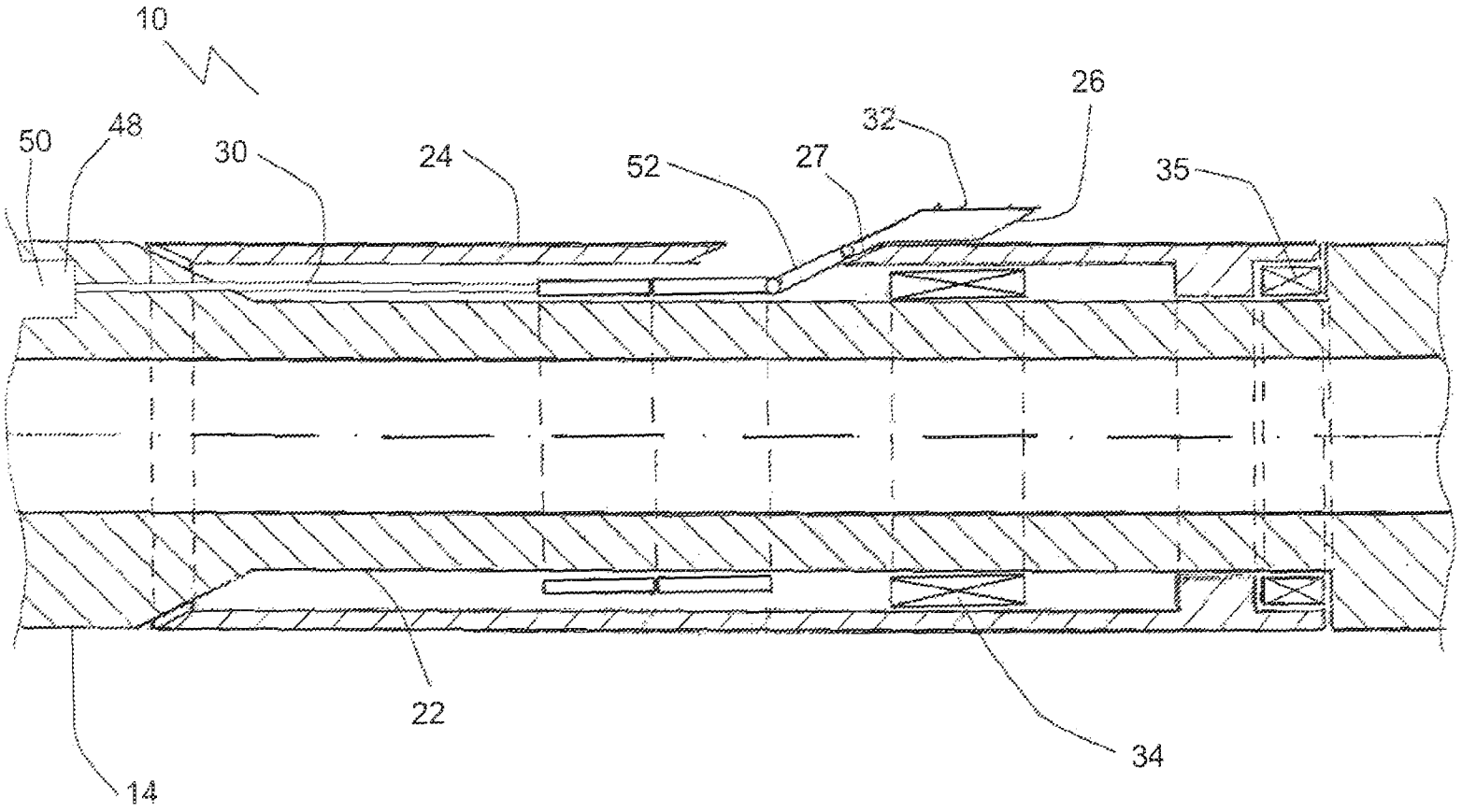
FIG. 8 is a side elevation view in section of a mechanically actuated tool in an engaged position.
Figure 9:
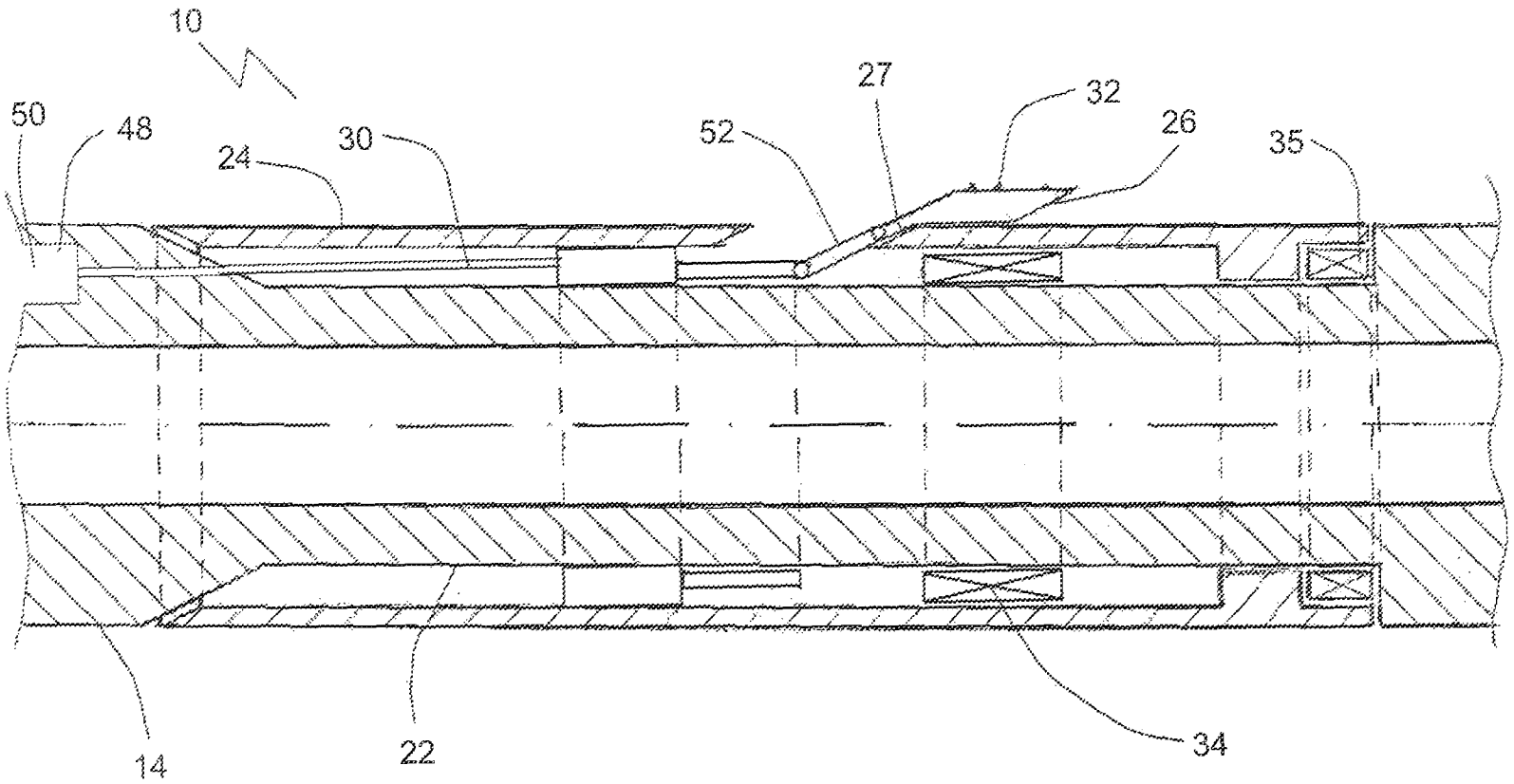
FIG. 9 is a side elevation view in section of a hydraulically actuated tool in an engaged position.

Another embodiment is shown in FIG. 5 through 8. When tool 10 receives the signal from the MWD tool, a power ring 44 is engaged and moves to push the non-rotating ring 46. The power ring 44 may be engaged in various ways as will be recognized by those skilled in the art. As depicted in FIGS. 5 and 6, power ring 44 is engaged by an electric motor 48 located inside the Non-Magnetic Drilling Pipe, which then drives an actuator 30. Alternatively, it may be driven mechanically, magnetically with an electric switch located inside the housing 24 below power ring 44. Referring to FIG. 6, another method includes the use of a hydraulic power source, where power ring 44 acts as a piston and forms a piston chamber. Engagement member 26 may be directly attached to power ring 44, although this is not preferred. Alternatively, there may be a hydraulic piston independent of the outer case and the power ring. A hydraulic fluid source 50 supplies fluid to drive the power ring 44 up. While not shown, there may also be another fluid line that forces the power ring 44 down to retract it. Alternatively, the hydraulic fluid source may be located on surface. Other ways of as will be recognized by those skilled in the art, with the necessary modifications being within the ordinary skill of those in the art. The selected method may depend on the outer diameter size and the preferences of the user.

As power ring 44 moves it causes the engaging member to move out of housing 24 and engage wellbore 28. As depicted, power ring 44 pushes the non-rotational ring 46. The force is transferred through pivoting connection 52 to engagement member 26 until it presses up against the wall of wellbore 28. After this, the entire drilling column is moved down a small distance as friction surface 32, which is made up of hardened steel as depicted, digs into the side of wellbore 28. The engagement member 26 then slides into its working position. When the engagement member 26 slides into its working position, MWD sensor 36 sends a signal to the ground, indicating that directional rotary drilling may commence.

While drill string 12 is rotating, the outer housing 24 does not. This is due to engagement member 26 pressing up against the inside of wellbore 28. Engagement member 26, through bearings 34 then presses onto drill string 12. Because of stabilizers 18, the pressure generated will cause an axial depression in the wellbore and causes drill string 12 to bend and thereby create an angle at which the drill bit 16 enters the earth. When the weight of the drill string is increased, a further axial depression against the wellbore will be created.

During directional rotary drilling, engagement member 26 is pressed up against wellbore 28, causing the hardened steel points on friction surface 32 to dig in. This stops outer housing 24 from moving and holds the correct angle.

To change the angle or to stop directional rotary drilling, the operation of drill string 12 is ceased and it is raised up from the bottom of wellbore 12. Because engagement member 26 is pressed up against wellbore 12, the friction will cause it to slide down and back into its retracted position. It may be necessary to reverse the electric motor or hydraulic power source while this occurs.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are to be understood to include what is specifically illustrated and described above, what is conceptually equivalent, and what can be obviously substituted. The scope of the claims should not be limited by the preferred embodiments set forth in the examples, but should be given the broadest interpretation consistent with the description as a whole.

What is claimed is:

1. A rotary steerable tool comprising:

an inner mandrel having a longitudinal axis;

an outer housing positioned along the inner mandrel, and the outer housing comprising:

a split case;

an engagement member that moves axially relative to the split case between an extended position and a retracted position, and the engagement member comprising a friction surface that engages an inner surface of a wellbore being drilled in the extended position; and a transition surface having a slope relative to an outer surface of the split case, the engagement member moving along the transition surface between the extended position and the retracted position, in the engaged position, the engagement member extending outward from the outer housing to engage the inner surface of the wellbore, and the outer housing rotating independently of the inner mandrel when the engagement member is in the engaged position; and an actuator that selectively moves the engagement member along the transition surface from the retracted position to the extended position, the actuator being powered by a power source.

2. The rotary steerable tool of claim 1, wherein the friction surface is connected to an internal portion by a pivoting connection.

3. The rotary steerable tool of claim 1, wherein the friction surface comprises a plurality of sharp points.

4. The rotary steerable tool of claim 1, wherein the actuator comprises a threaded rod and the power source comprises an electric motor or a mechanical motor.

5. The rotary steerable tool of claim 1, wherein the actuator comprises a piston and the power source comprises a hydraulic power source.

6. The rotary steerable tool of claim 1, wherein the actuator comprises a hydraulically actuated ring.

7. The rotary steerable tool of claim 1, wherein the inner mandrel is connected to a drill string.

8. The rotary steerable tool of claim 7, wherein the drill string comprises stabilizer members mounted at least one of above and below the outer housing.

9. The rotary steerable tool of claim 1, wherein the outer housing comprises a plurality of engagement members having a different height.

10. The rotary steerable tool of claim 1, wherein the outer housing comprises a pressure equalization valve.

11. A drill string for directional drilling comprising:

a rotary drill string body carrying a drill bit at a lower end of the rotary drill string body;

a rotary steerable tool spaced from the drill bit, and the rotary steerable tool comprising:

an inner mandrel having a longitudinal axis;

an outer housing positioned along the inner mandrel, and the outer housing comprising:

a spilt case;

an engagement member that moves axially relative to the split case between an extended position and a retracted position, the engagement member comprising a friction surface that engages an inner surface a wellbore being drilled in the extended position; and a transition surface having a slope relative to an outer surface of the split case, the engagement member moving along the transition surface between the extended position and the retracted position, in the engaged position, the engagement member extending outward from the outer housing to engage the inner surface of the wellbore, and the outer housing rotating independently of the inner mandrel when the engagement member is in the engaged position;

an actuator that selectively moves the engagement member along the transition surface from the retracted position to the extended position, the actuator being powered by a power source; and at least one set of stabilizers spaced along the rotary drill string body from the rotary steerable tool.

12. The rotary steerable tool of claim 11, wherein the friction surface is connected to an internal portion by a pivoting connection.

13. The rotary steerable tool of claim 11, wherein the friction surface comprises a plurality of sharp points.

14. The drill string of claim 11, wherein the actuator comprises a threaded rod and the power source comprises an electric motor or a mechanical motor.

15. The drill string of claim 11, wherein the actuator comprises a piston and the power source comprises a hydraulic power source.

16. The drill string of claim 11, wherein the actuator comprises a hydraulically actuated ring.

17. The drill string of claim 11, further comprising a set of stabilizers above and below the rotary steerable tool.

18. The drill string of claim 11, wherein the outer housing comprises a plurality of engagement members having a different height.

19. The drill string of claim 11, wherein the outer housing comprises a pressure equalization valve.

* * * * *